United States Patent [19]

Burnham

[11] 4,456,181

[45] Jun. 26, 1984

[54] GAS LIQUID MIXING NOZZLE

[75] Inventor: Richard C. Burnham, Greenfield, Mass.

[73] Assignee: Bete Fog Nozzle, Inc., Greenfield, Mass.

[21] Appl. No.: 369,565

[22] Filed: Apr. 19, 1982

[51] Int. Cl.[3] ..... B05B 7/10

[52] U.S. Cl. ..... 239/403; 239/424.5; 239/501

[58] Field of Search ..... 239/403, 399, 421, 422, 239/424.5, 428, 430, 433, 500, 501, 504, 518, 591, 600, 426

[56] References Cited

U.S. PATENT DOCUMENTS

| | | | |
|---|---|---|---|
| 409,751 | 8/1889 | Mathewson | 239/424 |
| 978,860 | 12/1910 | Dietz | 239/430 X |
| 1,071,381 | 8/1913 | Anthony | 239/422 X |
| 1,669,810 | 5/1928 | Clapham | 239/433 X |
| 2,804,341 | 8/1957 | Bete | 239/501 |
| 3,628,734 | 12/1971 | Lindell et al. | 239/403 |
| 3,777,981 | 12/1973 | Probst et al. | 239/426 X |
| 3,896,340 | 7/1975 | Dancy | 239/3 X |
| 4,221,339 | 9/1980 | Yoshikawa | 239/403 X |

FOREIGN PATENT DOCUMENTS

| | | | |
|---|---|---|---|
| 1040961 | 10/1953 | France | 239/426 |

*Primary Examiner*—John J. Love
*Assistant Examiner*—Mary F. McCarthy
*Attorney, Agent, or Firm*—Chapin, Neal & Dempsey

[57] ABSTRACT

A gas and liquid mixing nozzle for an abrasive type slurry is characterized by a central liquid passage and a helical vane disposed about the outlet end of the liquid passage to deflect the liquid outwardly into a generally flat spray pattern. The vane portion of the nozzle is preferably a separate insert formed of abrasion resistant material. An annular orifice is coaxially disposed about the outlet end of the liquid passage to eject an air stream into the liquid spray to mix therewith and form an aerated, high velocity spray. At the outer end of the helical vane is a deflector plug having a generally planar inner surface against which the liquid, issuing from the nozzle passage, impinges. The plug has a substantial axial length approximately the same as the axial dimension of the vane portion of the nozzle, and its outer periphery is inwardly and outwardly tapered toward the outer surface of the plug. This contour provides for a spray pattern of uniform droplet size.

1 Claim, 3 Drawing Figures

GAS LIQUID MIXING NOZZLE

BACKGROUND OF THE INVENTION

Fluid mixing nozzles for abrasive type slurries and high pressure air have been well known for many years. For example, one such nozzle for use in sand blasting operations is disclosed in U.S. Pat. No. 409,751. In this patent, a stream of sandcarrying water is combined with two air streams directed to mix with the liquid externally with the nozzle to minimize abrasive action on the nozzle itself. In recent years, pollution control devices have been growing in importance and are becoming more and more sophisticated. To reduce air pollution from contaminated stack gases, cooling of the gases initially to reduce the flow volume must be accomplished over very short distances within the stack. Consequently, cooling spray nozzles used for such purposes must be characterized by small liquid droplets having a generally large area and uniform spray pattern. In such applications, the generation of larger size droplets drastically reduces the cooling effectiveness of the nozzles because of the lesser liquid surface and longer residence time of the larger droplets. As a result, maximum evaporation and cooling effects are not achieved.

In more recent times, gas scrubbers have been designed to employ lime slurries. These slurries are most abrasive, and when used in a mixing nozzle which combines the slurries with high velocity air, abrasive wear on the nozzles is extreme. In these nozzles, which treat the gases as well as cool, the high velocity air and lime slurries are generally mixed internally of the nozzle, and in such environments, stainless steel parts may have a useful life of only a few hours, and even tungsten carbide nozzles erode extensively in a matter of about three or four weeks.

The principal object of this invention is to provide an improved mixing nozzle for cooling or treating sprays in which a liquid slurry and high velocity air are combined externally of the nozzle.

Another object of the invention is to provide a nozzle construction of the above type which has improved performance and wear characteristics as compared to presently available nozzles of the same type.

A further object of this invention is to provide a mixing nozzle having a discrete spray forming insert fabricated of an abrasion resistant material.

The above and other objects and advantages of this invention will be more readily apparent from a reading of the following drawings, in which.

Figure 1:
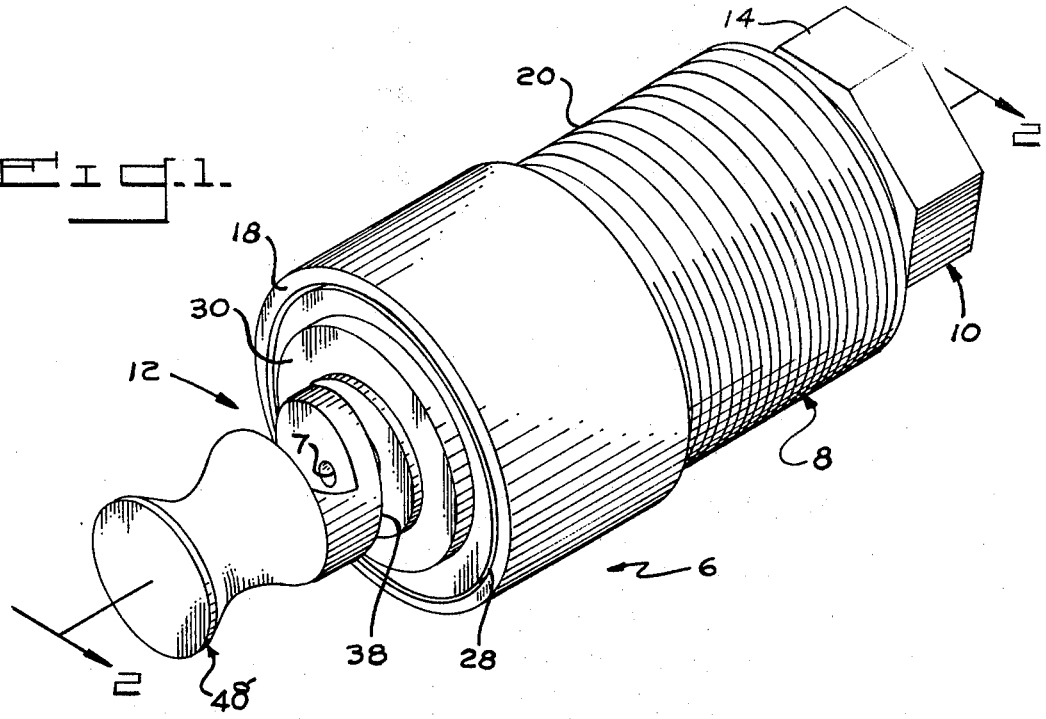
FIG. 1 is a perspective view of a nozzle of the type embodying this invention.

Referring in detail to the drawing, in FIG. 1 is shown a fluid mixing nozzle 6. The nozzle combines an inlet end portion 10 and an outlet or spray portion 12. The inlet end of the nozzle includes a tubular coupling member 14 for connecting a conduit or hose 16 (FIG. 2), which supplies a liquid slurry under high pressure to the internal bore 7 of the nozzle. As shown, the end of the hose 16 is externally threaded and is screw fitted onto the threaded inner bore of the coupling member 14, which has a hexagonal outer surface for driving engagement by a wrench used for attachment and removal thereof. The coupling member 14 is also externally threaded at its inner end and is screw fitted within the inner end of a tubular sleeve 18.

The body portion of the nozzle comprises the sleeve 18 externally threaded as at 20 for coupling with an internally threaded fluid hose or conduit 22. A plurality of bores 24 extend longitudinally within the wall of the sleeve 18 and serve to supply high pressure air to annular chamber 26, which in the manner of a manifold, equalizes the air pressure from the several bores 24 and communicates with annular orifice 28.

Figure 2:
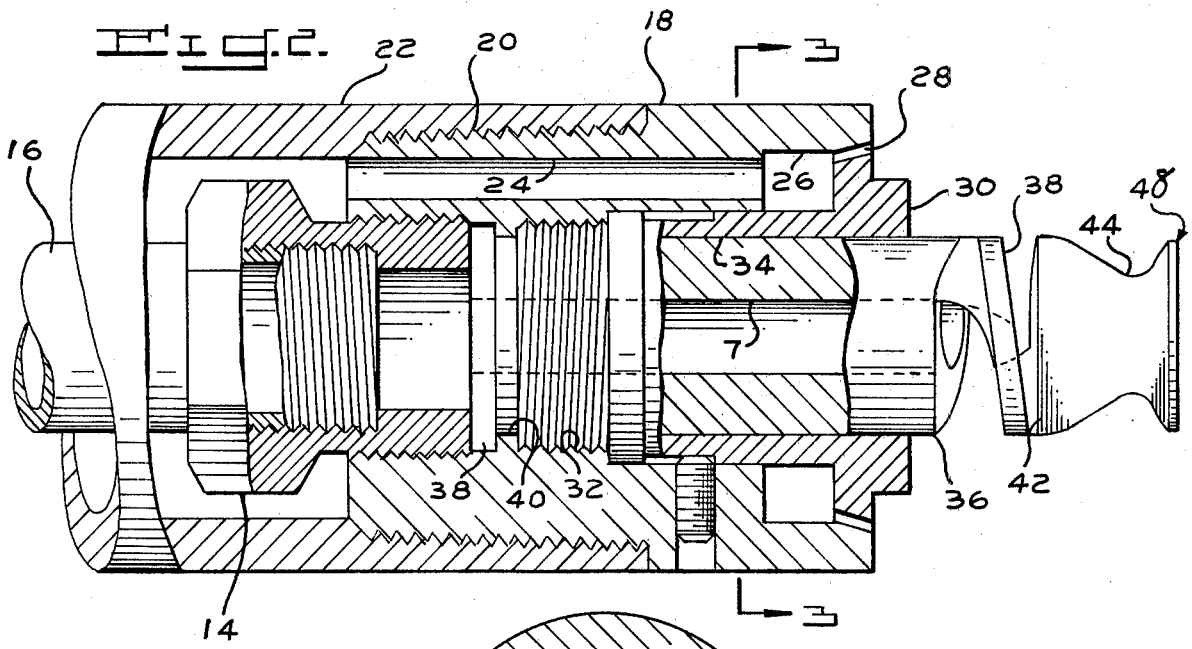
FIG. 2 is a cross section view of the nozzle taken along line 2—2 of FIG. 1, but with outer tubular conduit coupled thereto.
Figure 3:
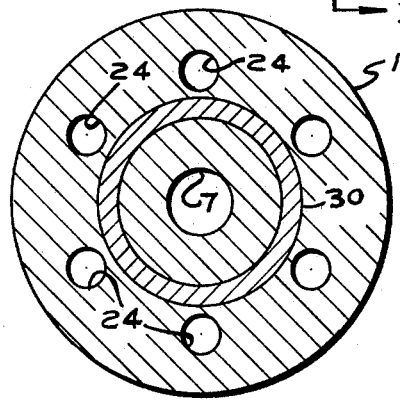
FIG. 3 is a cross sectional view taken along line 3—3 of FIG. 2.

As best shown in FIG. 2, the orifice 28 is defined by an outwardly flaring conical surface formed on the outer end of the sleeve 18 and an opposed parallel surface of the same configuration formed on the outer end portion of tubular fitting 30. The outer surface of fitting 30 is shaped to define the inner surface portion of chamber 26 and orifice 28, while the outer surface of the chamber 26 and the orifice are defined by the sleeve 18 disposed coaxially about the fitting 30. The inner end portion of the sleeve 30 is threaded as shown at 32 and screw fits within the sleeve 18. The orifice forms a complete annulus about the axis of the nozzle for supplying high velocity air in an expanding cone-shaped stream for mixing with a liquid slurry spray emanating from the bore of the nozzle 6. The pressure of the air supplied to the nozzle may be in the range of from 10 to over 100 PSI, and such nozzles commonly operate in the 40–70 PSI range.

The tubular fitting 30 has an inner cylindrical bore 34 dimensioned to receive therethrough with a close sliding fit nozzle insert 36. The inner end of insert 36 includes at its inner end an enlarged flange 38 adapted to abut a shoulder 40 formed within the inner diameter of the sleeve 18, whereby the nozzle insert can be assembled within the nozzle by simply fitting it through the inner bore of the sleeve 18 and the inner bore 34 of the fitting 30. This assembly would, of course, be carried out before connection of the air and liquid spray conduit and the coupling member 14.

The insert 36 includes a cylindrical inner surface with a fluid bore 7, which communicates with the fluid conduit 16 and the tubular coupling member 14. Liquid such as a lime slurry may be supplied to the nozzle under pressure in the range of 5 to 100 PSI. The outer end portion of the insert includes a helical vane having generally planar surfaces facing the upstream end of the nozzle so that a liquid slurry flowing from the outer end of the bore 7 will strike the upstream side of the vane 38. The liquid is thereby deflected outwardly into a generally flat sheet approximately perpendicular to the axis of the nozzle. The vane makes approximately one complete turn of 360° from its inner to its outer end. The pitch of the helix is about four turns per inch, and thus, the axial length of the vane portion of the insert is about a quarter of an inch. At its outer end, the vane terminates at a liquid deflector plug 48. The inner surface 42 of the deflector is of generally planar configuration normal to the axis of the nozzle. The axial length of the plug is preferably about the same as the length of the vane portion of the insert.

The outer surface of the plug 48 tapers inwardly from the periphery of its liquid deflecting surface 42 and then flares outwardly, defining a reduced throat portion 44 (FIG. 2). A portion of the liquid from the orifice will flow over this surface. At its outer end, the plug 48 has a generally flat surface parallel to its inner surface 42.

The throat portion of the plug provides means for deflecting outwardly any relatively large drops of water which accumulate on this surface. Such large droplets, which may result from some of the liquid not being deflected by the vane 38 not the flat surface 42 will flow over the contoured surface of the plug and will ultimately be thrown outwardly by air flowing over the periphery of the plug. The liquid will be thus impelled into the high velocity airstream issuing from the orifice 28. As a consequence, the mixing nozzle embodied in this invention overcomes the drawbacks of mixing nozzles heretofore available, in which relatively large droplets of water are often emitted along the axis of the nozzle, thereby reducing the liquid surface area of the resulting spray.

Since the slurries used in gas scrubbers are highly abrasive, the insert is preferably fabricated of a material having a high abrasion resistance, such as stellite, stainless steel, or other special alloy. The discrete insert 36 can be readily assembled with the other nozzle components, and in the event of erosion to the spray forming surface of the nozzle, the insert can be removed and replaced by another insert without the necessity of replacing the entire nozzle.

In operation, when the liquid slurry is turned on, it flows through the bore of the nozzle, and a suitable source of compressed air is simultaneously supplied to the fluid conduit 22. As the liquid flowing from the bore 7 impacts against the vane 38, a flat liquid spray is generated. Without the air stream, this spray would have a relatively large diameter on the order of about 10–12 feet at normal operating pressures. At a short distance radially outward of the nozzle vane, an annular, conical stream of high velocity air issuing from the annular orifice 28, which may be on the order of 1100 feet per second (40 PSI) impacts and mixes with the flat sheet of liquid droplets. The cone shaped air stream causes a rapid acceleration in the velocity of the liquid particles and deflects the liquid sheet into a high velocity, conical spray of very fine liquid particles. This conical spray is ideally suited as a cooling or treating spray for gas scrubber applications.

Having thus disclosed this invention, what is claimed is:

1. Mixing Nozzle for gas and a liquid slurry comprising a tubular member having a plurality of longitudinally extending, circumferentially spaced gas supply passages communicating at their outer ends with an annular chamber adjacent the outer end of said nozzle, an annular gas flow orifice being in communication with said annular chamber, a discrete, abrasion-resistant-insert removably fitted within the tubular member and having an axial bore for liquid flow therethrough, said insert including at its outer end a helical vane disposed externally of said tubular member and in axial alignment with said bore, said vane having a pitch such that liquid flow through the bore impinges against said vane and is deflected outwardly into a generally flat sheet approximately normal to the axis of the nozzle, the outer end of said helical vane terminating in a deflector having a generally flat inner end surface, the outer periphery of said deflector having a throat portion of reduced diameter intermediate its inner and outer end surfaces, said annular orifice being coaxial with the bore of said insert and having a generally conical cross-section and being directed such that an extension thereof intersects the liquid spray at a substantial distance outwardly of said vane whereby pressurized gas issuing from said gas flow orifice mixes with said liquid spray to form a high-velocity conical spray.

* * * * *